US012747654B1

(12) United States Patent
Su et al.

(10) Patent No.: US 12,747,654 B1
(45) Date of Patent: Sep. 29, 2026

(54) MODULAR ANTI-ROTATION DRILLING SYSTEMS AND METHODS ACTUATED BY FLUID PRESSURE

(71) Applicant: National Technology & Engineering Solutions of Sandia, LLC, Albuquerque, NM (US)

(72) Inventors: Jiann-Cherng Su, Albuquerque, NM (US); Stephen Buerger, Albuquerque, NM (US); Anirban Mazumdar, Atlanta, GA (US); Adam Foris, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 18/103,271

(22) Filed: Jan. 30, 2023

Related U.S. Application Data

(60) Continuation-in-part of application No. 17/412,397, filed on Aug. 26, 2021, now Pat. No. 11,566,497, (Continued)

(51) Int. Cl.
*E21B 43/10* (2006.01)
*E21B 4/00* (2006.01)

(Continued)

(52) U.S. Cl.
CPC ..... *E21B 43/106* (2013.01); *E21B 4/006* (2013.01); *E21B 4/18* (2013.01); *E21B 17/02* (2013.01);

(Continued)

(58) Field of Classification Search
CPC .. E21B 17/02; E21B 17/1057; E21B 17/1064; E21B 17/00; E21B 17/006; E21B 17/10; E21B 17/1014; E21B 17/1021; E21B 17/1078; E21B 43/106; E21B 4/18; E21B 17/041; E21B 4/006; E21B 29/00; E21B 29/005; E21B 4/04
See application file for complete search history.

(56) References Cited

U.S. PATENT DOCUMENTS 1,898,074 A * 2/1933 Bailey ..... E21B 17/1021 15/104.061
5,242,020 A * 9/1993 Cobern ..... E21B 23/01 175/50

(Continued)

*Primary Examiner* — George S Gray
(74) *Attorney, Agent, or Firm* — Daniel J. Jenkins

(57) ABSTRACT

A modular anti-rotation, centering and notching device for preventing off-axis movement of a drillstring with respect to the central axis of a drilling tool in a borehole and for producing a notch in a borehole surface. The device includes an upper fixture portion and a lower fixture portion in axial alignment. The upper fixture portion and the lower fixture portion are connected by yoke assemblies. Each yoke assembly is connected to the fixture portion and fixture portion at one end, and forming an articulated joint of the upper yoke assembly and the lower yoke assembly at a distal end opposite the first end. A roller is connected at each joint, connecting the upper and lower yoke assemblies. The rollers or cutters engage vertically with a borehole surface when fluid pressure is applied to the upper fixture portion.

16 Claims, 8 Drawing Sheets

Related U.S. Application Data which is a division of application No. 15/809,639, filed on Nov. 10, 2017, now Pat. No. 11,131,167.

(51) Int. Cl.
*E21B 4/18* (2006.01)
*E21B 17/02* (2006.01)
*E21B 17/10* (2006.01)

(52) U.S. Cl.
CPC ..... *E21B 17/1021* (2013.01); *E21B 17/1057* (2013.01); *E21B 17/1078* (2013.01); *E21B 17/10* (2013.01)

(56) References Cited

U.S. PATENT DOCUMENTS 5,758,723 A * 6/1998 Saucier ..... E21B 17/1021 166/241.6
2016/0138369 A1* 5/2016 Tunget ..... E21B 37/02 166/174
2016/0362953 A1* 12/2016 Bedrossian ..... E21B 4/18

* cited by examiner

MODULAR ANTI-ROTATION DRILLING SYSTEMS AND METHODS ACTUATED BY FLUID PRESSURE

CROSS-REFERENCE TO RELATED APPLICATIONS

This is a continuation-in-part of U.S. patent application Ser. No. 17/412,397, which was filed on Aug. 26, 2021, entitled "MODULAR ANTI-ROTATION DRILLING SYSTEMS AND METHODS", which is a divisional of U.S. patent application Ser. No. 15/809,639, which was filed on Nov. 10, 2017, entitled "MODULAR ANTI-ROTATION DRILLING SYSTEMS AND METHODS", which is hereby incorporated herein by reference in its entirety.

STATEMENT REGARDING FEDERALLY SPONSORED RESEARCH OR DEVELOPMENT

This invention was developed under Contract No. DE-NA0003525 awarded by the United States Department of Energy/National Nuclear Security Administration. The Government has certain rights in this invention.

BACKGROUND OF THE INVENTION

The application generally relates to drilling. The application relates more specifically to anti-rotation, centralizing and borehole conditioning tools for modular drilling systems.

Drilling dysfunction is a major cause of slower drilling rates, damaged hardware, and increased drilling costs. Drilling dysfunction may result from drill string twist and the inability of the drilling assembly to manage the load, or weight-on-bit that is applied at the drill bit. This problem is more likely to occur when drilling long distances, with smaller drill pipe, or when rotation is generated downhole. Downhole rotation is generated downhole, e.g., when drilling with a positive displacement motor (PDM) or turbine. Torque generated by downhole rotation creates twist in the drillstring which leads to stored energy in the drillstring. Releasing the stored energy due to bit slip or drilling dynamics can damage downhole components.

In addition, drill strings may move off of the center axis of the borehole because of drill string twist and borehole deviation from vertical. Moving off center may cause stuck pipe and additional wear on tool joints.

Further in addition, hydraulic stimulation of a borehole in the absence of perforation or notching tends to produce fractures along the length of the borehole because the wellbore itself causes significant concentration of the hoop stress but only minor alteration to the axial stress. In order to generate fractures perpendicular to the axis of the borehole (i.e., a transverse fracture) and at known axial position in the borehole, a mechanism to cause stress concentration in the axis direction, such as a circumferential notch, must be generated perpendicular to the axis of the borehole. Although several approaches such as sand blasting or water-jetting can be used to produce this type of feature, this work describes a case-study utilizing a mechanical tool to notch the borehole.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY OF THE INVENTION

According to one embodiment of the disclosure, a modular device is disclosed that includes an upper mount fixture and a lower mount fixture disposed opposite thereof and in axial alignment therewith, the upper mount fixture slidably disposed within a drillstring having a central axis that allows for fluid pressure to move the upper mount fixture towards the lower mount fixture, the lower mount fixture fixed to the drillstring so as to not allow for slidable movement within the drill pipe; two or more yoke assemblies connecting the upper mount fixture and the lower mount fixture; each yoke assembly an upper yoke and lower yoke to form an articulated joint; and a tool connected to a first end of the upper and lower yokes. Wherein upon moving the upper mount fixture towards the lower mount fixture, the articulated joint moves radially way from the central axis of the drill pipe to radially move the tool away from the axis.

According to another embodiment of the disclosure, a method for axially aligning a drillstring in a well borehole having a borehole surface is disclosed that includes adding to a drillstring above the drilling motor a device that deploys tools against the borehole surface at an axial location where the device is axially located within the borehole; disposing the drillstring into the borehole; applying fluid pressure from a fluid to the device to deploy the tools against the borehole surface at the axial location. Wherein the device includes an upper mount fixture and a lower mount fixture disposed opposite thereof and in axial alignment therewith, the upper mount fixture slidably disposed within the drillstring having a central axis that allows for fluid pressure to move the upper mount fixture towards the lower mount fixture, the lower mount fixture fixed to the drillstring so as to not allow for slidable movement within the drillstring; the upper mount fixture and the lower mount fixture connected by at least two yoke assemblies; each yoke assembly an upper yoke and lower yoke to form an articulated joint; and the tool connected to a first end of the upper and lower yokes. Wherein upon moving the upper mount fixture towards the lower mount fixture, the articulated joint moves radially way from the central axis of the drill string.

An advantage of the present disclosure is that coulomb friction at this interface allows torque to be reacted without any rotation of the modular device or the drill string above the modular device. This reaction torque limit is proportional to the applied weight-on-bit.

Another advantage is that the device is able to adapt to and function in different borehole sizes because the links automatically expand under load until they contact the borehole wall.

Another advantage of the notching tool embodiment is the ability to precisely locate stress concentrations in a borehole which enables targeted stimulation.

Alternative exemplary embodiments relate to other features and combinations of features as may be generally recited in the claims.

BRIEF DESCRIPTION OF THE DRAWINGS

The application will become more fully understood from the following detailed description, taken in conjunction with the accompanying figures, wherein like reference numerals refer to like elements, in which.

DETAILED DESCRIPTION OF THE INVENTION

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
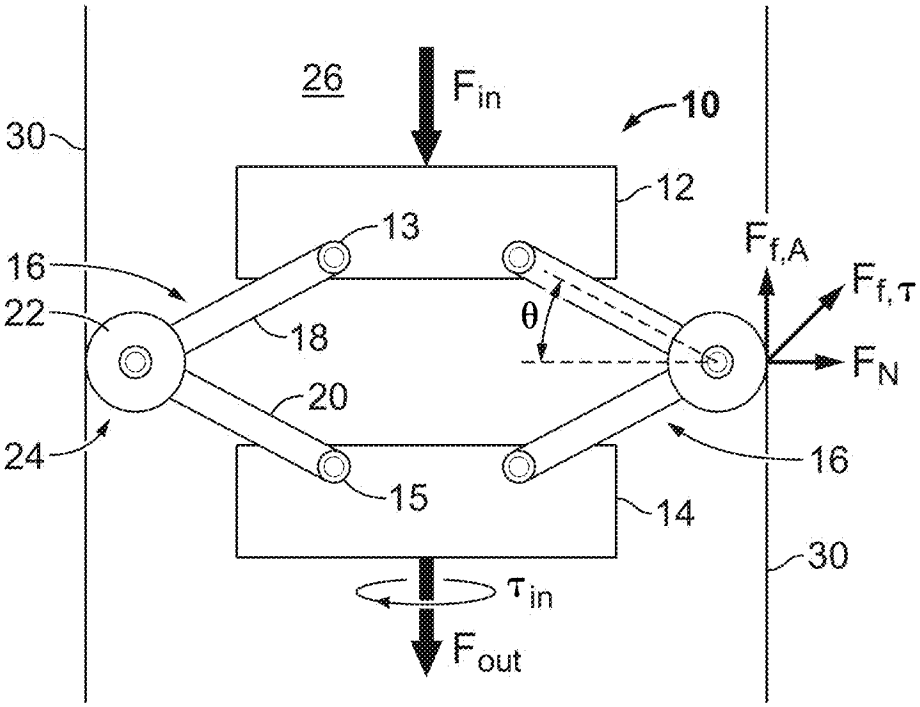
FIG. 1 shows a schematic diagram of a modular device of the present invention.

FIG. 1 is a simplified schematic diagram of a modular anti-rotation device 10, which will be hereafter referred to as "device 10," according to an embodiment of the disclosure. Device 10 includes an upper mount fixture 12 and a lower mount fixture 14. Upper mount fixture 12 and lower mount fixture 14 are disposed opposite one another in axial alignment within a borehole 26 having a borehole surface 30. The upper mount fixture 12 and lower mount fixture 14 are connected by two or more yoke assemblies 16. In another embodiment, the device 10 includes three or more yoke assemblies 16. In another embodiment, the device 10 includes four or more yoke assemblies 16. Each yoke assembly 16 includes an upper yoke 18 and a lower yoke 20. The upper and lower yokes 18, 20 are substantially identical in structure but of different dimension to allow overlapping engagement of the roller 22.

Figure 2:
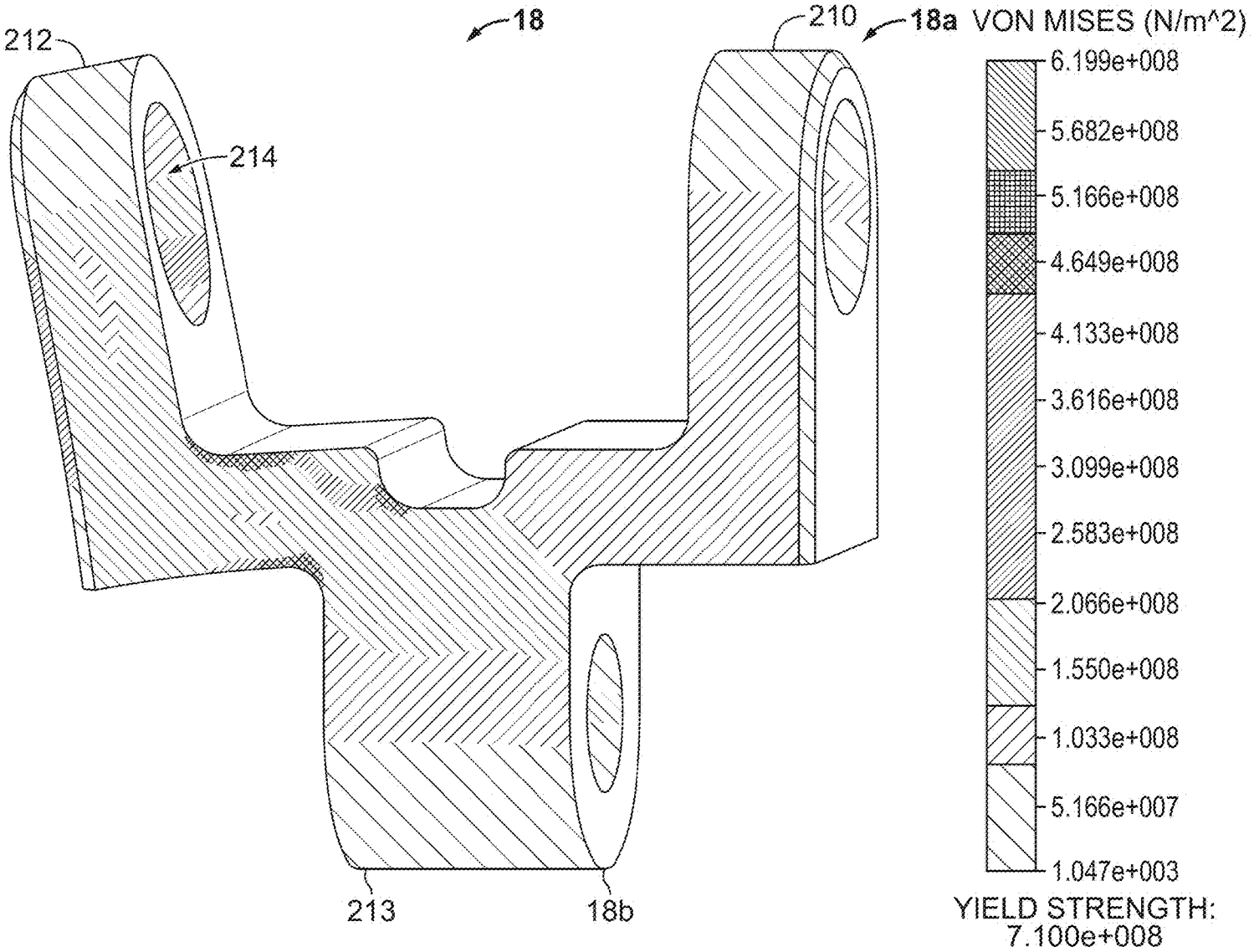
FIG. 2 shows a yoke assembly portion of the modular device of FIG. 1.
Figure 6:
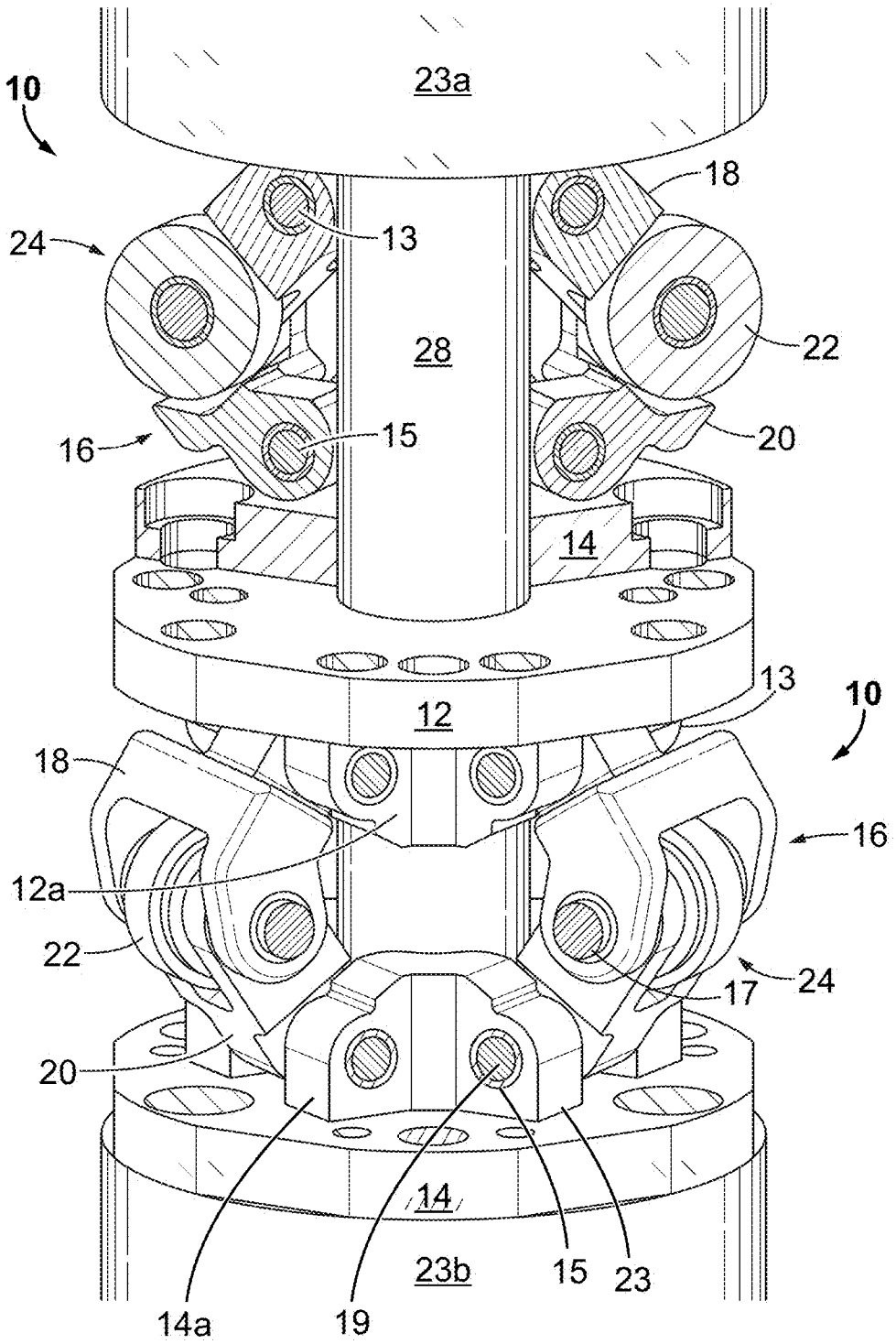
FIG. 6 shows a perspective view of the modular device of FIGS. 1 and 3.

FIG. 2 illustrates an embodiment of an upper yoke 18 according to an embodiment of the disclosure. As can be seen in FIG. 2, the upper yoke includes opposing yoke arms 210, 212 at a first end 18*a*. Yoke arms 210, 212 engage a tool such as roller 22 and yoke arms of a lower yoke as illustrated in FIG. 6. Yoke arm 213 at an opposing or second end 18*b* engages with upper yoke mount 12*a* (see FIG. 6) to pivotally secure the yoke arm 213 with upper mount fixture 12. Arms 210, 212 are sized on respective yoke assemblies 18, 20 so as to be configured in overlapping relation at the first end 24 with the first end of a lower yoke as shown in FIG. 6 and connected by a first cross bolt 17 (see FIG. 6) traversing the yoke arms through respective yoke opening 214 aligned coaxially for insertion of the cross bolt 17 (FIG. 6). In this exemplary embodiment, the first end 18*a* has two yoke arms, in other embodiments, the first end may have two or more yoke arms. In this embodiment, the second end 18*b* has one yoke arm, in other embodiments, the second end 18*b* may have one or more yoke arms.

Cross-bolt 17 also traverses roller 22 disposed between yoke arms 210, 212 in pivotal, radial arrangement on the cross bolt to allow axial displacement in a vertical direction in a drill borehole 26 as drill pipe casing 23 (see FIG. 6) penetrates downwardly in rock or other material. Rollers 22 engage borehole surface 30 and travel axially downward as drill pipe casing penetrates further into the borehole 26.

FIG. 6 also shows an upper pipe adapter 23*a* that connects the device 10 to a drill string (not shown). FIG. 6 also shows a lower pipe adapter 23*b* that also connects the device 10 to the lower drill string (not shown), the lower drill string including the drilling motor that rotates a drill bit. As can be further seen in FIG. 6, a central fluid pipe 28 axially traverses the device 10 to provide drilling fluid through the device 10 to the drilling motor end of the drill string. Upper and lower mount fixtures 12, 14 are axially slidable over the central fluid pipe 28. In the exemplary embodiment shown in FIG. 6, the device 10 is not surrounded by a housing as shown in the embodiment shown in FIG. 7, however, in other embodiments, the device 10 may be surrounded by a flexible housing similar in design to the that shown in FIG. 7, but that allows for compression between the upper and lower pipe adapters 23*a*, 23*b*.

In this exemplary embodiment, rollers 22 have a smooth surface. In other embodiments, the rollers 22 may have rough, grooved, toothed or other frictional surfaces. In other embodiments, the rollers 22 may include teeth (see embodiment shown in FIGS. 4 and 5) or other features that increase friction between the rollers 22 and the borehole surface 30. For example, FIGS. 4 and 5 illustrate a sawtooth profile, along the peripheral edge for engaging borehole surface 30 that enhances the prevention of radial rotation of modular device 10 within borehole 26 while allowing easy vertical displacement with borehole 26.

Figure 3:
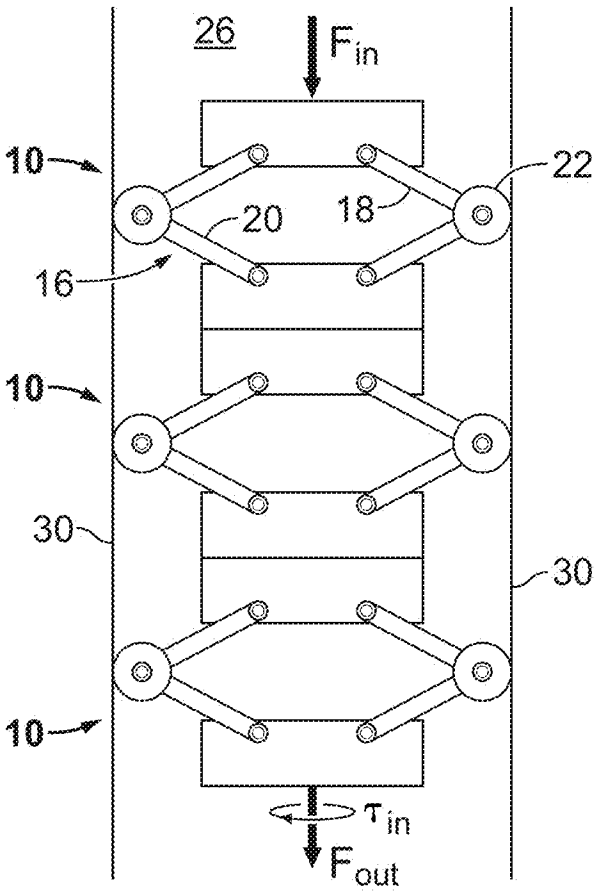
FIG. 3 shows an embodiment of multiple copies of modular device may be arranged in series in a borehole.
Figure 4:
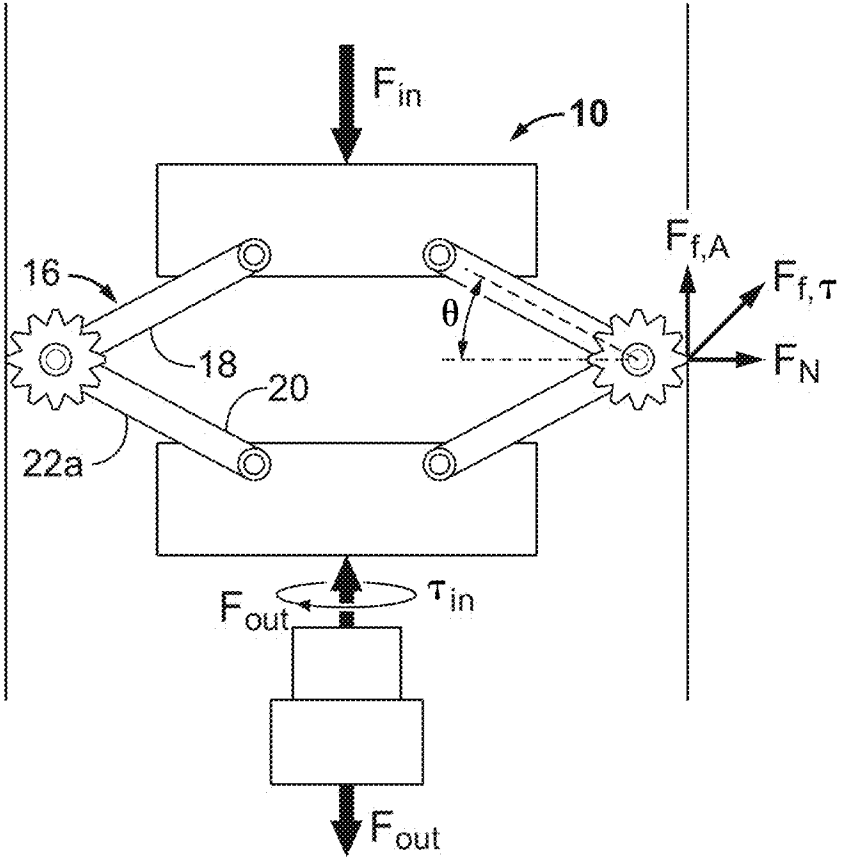
FIG. 4 shows a yoke assembly of FIG. 4 arranged to provide a vertical locking position for a modular device in a borehole.
Figure 5:
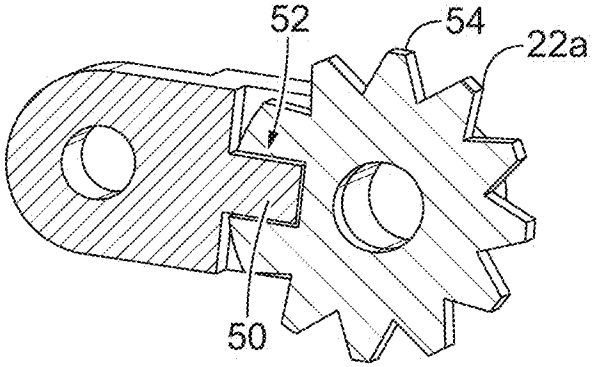
FIG. 5 shows an alternate embodiment of a yoke assembly with keyed interconnection for locking a wheel against rotation.

As shown in FIGS. 1, 3, and 4, a downward force $F_{in}$ is applied to upper mount fixture 12 via the upper pipe adapter 23*a* (see FIG. 6) from force applied thereto from the upper drillstring to compress the device 10 so as to extend the rollers 22 in a direction perpendicular to the axis of the borehole 26. The force $F_{in}$ is applied by the upper pipe adapter 23*a* shown in FIG. 6. Force is applied to the upper pipe adapter 23*a* by constant or modulating force at the surface on the drill string. It should be noted that in FIG. 6 that an upper mount fixture is hidden the upper pipe adapter 23*a* to which it is affixed, and the middle mount fixture 12 acts as a lower mount for the upper device and as an upper mount fixture for the lower device. The lower mount fixture 14 is fixed to the lower drill pipe 23 to which it is attached is cut away.

As further shown in FIGS. 1, 3 and 4, a rotational force $F_{out}$ is present while drilling by the rotation of the drillstring. As discussed above, rotational force on the drillstring from rotation of the drilling motor and bit below the device may cause the drillstring to move away from the center axis of the borehole 26. The device 10 mitigates, limits or prevents the moving off axis of the drillstring to which the device 10 is inserted axially into at one or more locations in the drillstring.

Upper and lower yokes (yokes) 18, 20 are fastened at opposite ends from roller 22 at attachment points 13, 15 on upper mount fixture 12 and lower mount fixture 14, respectively, to form a linkage between upper mount fixture 12 and lower mount fixture 14. FIG. 6 shows a more detailed view of the attachment points 13 and 15. As can be seen in FIG. 6, yokes 18, 20 are attached to upper and lower yoke mounts 12*a*, 14*a*, respectively, attached to upper and lower mount fixtures 12, 14, respectively.

Modular device 10 utilizes applied axial load from above via the drill string, referred to as weight-on-bit (WOB) to generate forces against borehole surface 30. The radial forces are transmitted via yoke assemblies 16, which are attached to upper mount fixture 12 and lower mount fixture 14. The lateral or radial force transmitted to borehole surface 30 is determined by the magnitude of the WOB, the geometry of yoke assemblies 16 and the diameter of borehole 26. Radial forces are amplified or attenuated at borehole surface 30 in response to the controlled mechanical advantage imparted by yoke assemblies 16. Specifically, if the modular device 10 is implemented with rigid links and pin joints, the radial force, or normal force, $F_N$, on the borehole surface 30 is proportional to the inverse of the tangent of the angle θ, as shown in Equation 1 below:

$$F_N = \frac{F_{in}}{\tan\theta} \qquad \text{EQ. 1}$$

By shortening the link lengths or moving their pivot points closer to modular device 10 centerline, angle θ is reduced, and $F_N$ is increased. If θ<45°, then $F_N > F_{in}$ in theory, where $F_{in}$ is the downward, or input, force. Rollers 22 allow modular device 10 to move axially, with minimal loss to friction, while reacting torsion due to torque generated by a downhole motor or other device to perform drilling. The size, diameter and profile, or contact area, influence the performance of modular device 10. A downhole motor mounted below modular device 10 applies the torque required for drilling. Modular device 10 also provides a conduit to allow drilling mud or other cutting fluids to be circulated through the borehole during drilling. Multiple units of modular device 10 may be connected, or stacked, axially to react more torque as necessary based on the drilling requirements and the output of the motor. The tool can be used in a variety of formations and can be tailored for various rotation reaction loads.

Modular device 10 includes novel features that are central to its novelty, function, and benefits. The reaction torque limit of modular device 10 is proportional to the applied weight-on-bit. In drilling, the process torque for effective drilling generally increases with applied weight-on-bit. In this device, because $F_N$ is proportional to $F_{in}$, as indicated above, the reaction torque limit automatically increases with weight-on-bit. Any torque below the reaction torque limit may be accommodated without rotary slip.

The relationship between radial force and weight-on-bit can advantageously be tuned using device parameters to achieve design criteria, e.g., the link lengths and joint locations may be modified, or adjusted, to modify the mechanical advantage provided by modular device 10 to increase or decrease the normal force $F_N$ applied against wall surface 30 and the associated friction.

Further, friction may be made asymmetric, e.g., by using rolling elements 22, to enable large reaction torques and transmission of weight on bit. In one embodiment, it may be desirable to directly modulate the process weight-on-bit by modulating $F_{in}$ from the top of the hole. In one exemplary embodiment, a section of heavy drill pipe may be mounted to the top fixture 12 of modular device 10 and suspended by a cable (not shown) from the top of the hole. $F_{in}$ may be thus modulated by changing the tension in the cable. In this case, it is desired for $F_{out}$ to approach $F_{in}$, i.e., for as much of the weight as possible to be transmitted through modular device 10. Thus, a low friction force $F_{f,A}$ may be preferred.

Force vectors are represented in FIG. 1, indicating as follows;

$$\text{Output force: } F_{out} = F_{in} - \mu_A \frac{F_{in}}{\tan\theta} \qquad \text{Eq. 2}$$

$$\text{Torque/Force: } F_{f,\tau} = \mu_\tau F_N \qquad \text{Eq. 3}$$

$$\text{Vertical Friction: } F_{f,A} = \mu_A F_N \qquad \text{Eq. 4}$$

$$\text{wherein Torque in is: } F_{f,\tau} r_{hole} \geq \tau_{in} \qquad \text{Eq. 5}$$

where μ_A is defined as the effective coefficient of friction (e.g., rolling friction) between the rollers and the borehole surface in the axial direction. μ_tau is the effective coefficient of friction (e.g., sliding friction) between the rollers and the borehole surface in the rotary/tangential direction. F_f,tau is in the tangential "rotation" direction.

However, a high friction force $F_{f,\tau}$ may be desired in order to react torque. This may be accomplished by using wheels or rollers designed to roll along the borehole wall, producing very low friction in the vertical direction of rolling, and much higher friction in the normal direction of rotation which requires sliding movement perpendicular to the preferential rolling direction of the wheels.

Referring again to FIG. 3 and FIG. 6, multiple modular devices 10 may be arranged in series in the borehole 26 in another embodiment of the disclosure. Placing multiple copies of modular devices 10 in series provides favorable scaling. The maximum reaction torque of a single modular device 10 is limited by the applied weight-on-bit, the geometry of the device, the angle θ, and the coefficient of friction between the rollers and the borehole surface 30 in the circumferential/rotary direction. There are practical limits to θ, and the coefficient of friction depends on material properties, tool wear, and other factors that are difficult to control. It is also inconvenient and expensive to use large weights. One way to increase the limiting torque without increasing weight is to stack additional tools in series, as shown in FIGS. 3 and 6.

The reaction torque provided by each module adds in parallel, such that the total reaction torque is the sum of the reaction torque from each module. If friction is low in the drilling direction, each module sees approximately the same axial force, with the only loss coming from friction in the preferred rolling direction. Therefore, the reaction torque limit can be increased dramatically with only a fractional increase in applied weight. Equations 6 and 7 below provide a mathematical description of the cumulative forces $F_{out}$ and $F_{f,\tau}$:

$$F_{out} = F_{in}\left(1 - \frac{\mu_A}{\tan\theta}\right)^N \text{ and} \qquad \text{Eq. 6}$$

$$F_{f,\tau} = \sum_{i=1}^{N} \frac{\mu_\tau F_{in}}{\tan\theta}(1-\mu_A)^{i-1} \qquad \text{Eq. 7}$$

FIG. 4 illustrates another embodiment of the disclosure. In this embodiment, rollers 22 shown in FIGS. 1, 3 and 6 are replaced by toothed rollers 22*a* having teeth 54 to provide additional frictional engagement between the device and the borehole 30. FIG. 5 illustrates another embodiment of the toothed roller 22*a* in which the toothed roller has a keyhole 52 into which a key 50 can be inserted so as to prevent the toothed roller from rolling and locking the toothed roller into place. In such a manner, the device 10 can lock the drillstring in an axial position in the borehole. The engagement of the key 50 into the toothed roller 22*a* may be accomplished by an actuator, such as an electric or hydraulic actuator as would be well understood in the art.

Device 10 reacts to linear force as well as rotary torque. In this case, the device may be configured for maximum force amplification, i.e., minimum angle θ, and maximum friction in all directions, i.e., $\mu A=\mu\tau=1$, where μA and μt are coefficients of friction, respectively. Rather than rollers, fixed toothed rollers 22*a* or other types of rollers with high-friction surfaces would be used to contact the borehole wall 30. This would potentially enable a minimal total downhole tool weight, as a very small weight could be used to lock the device and react much larger weights-on-bit and torque.

While the drawings disclose an embodiment having generally rigid links and pin joints, modular device 10 may be implemented in other ways as well. In some embodiments, each two-link assembly may be implemented as a single flexural element to achieve a similar functionality in less expensive and possibly more robust package, and enable the effective angle θ to be selectively tailored and varied based on the position of modular device 10. Multiple contact geometries may also be used including, e.g., relatively sharp wheels that create line contact and dig into softer rock; with smooth roller surfaces whose radius matches the wellbore for a large contact area; and with knurled roller surfaces to create smaller regions of contact over a large area. Other variants may be used for particular tool/rock interfaces.

Figure 7:
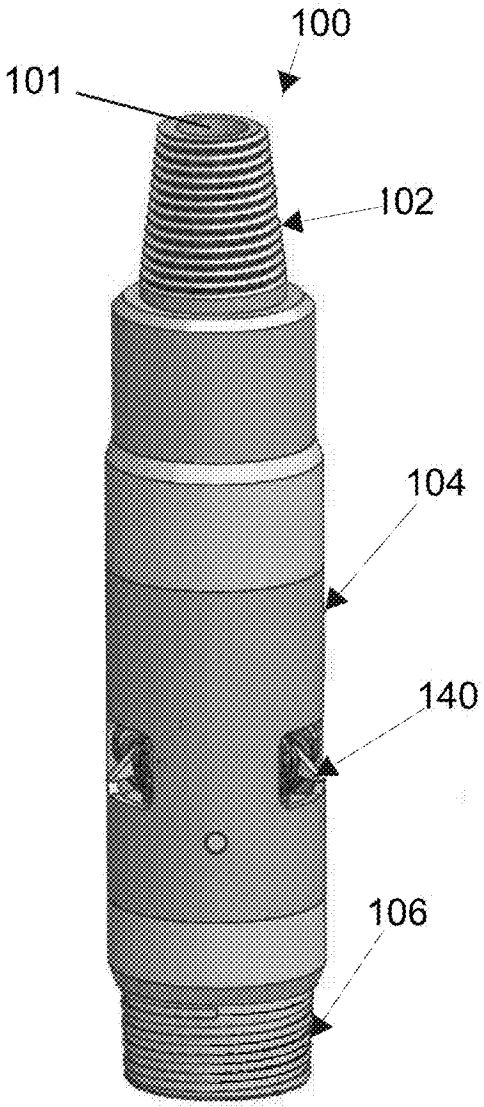
FIG. 7 shows another exemplary embodiment of a borehole notching assembly for notching a borehole in an earth surface formation.

FIG. 7 illustrates another embodiment of a borehole notching assembly (assembly) 100 according to an embodiment of the disclosure. As can be seen in FIG. 7, the assembly 100 includes an upper pipe adapter 102, a housing 104 and a lower adapter 106. The drill pipe adapters 102, 106 are used to insert and attach the assembly 100 into a drillstring as is known in the art. The assembly 100 includes a fluid passage 101 that passes through the assembly 100 such that fluid entering the drill pipe adapter 102 exits the pipe adapter 106. The housing 104 contains a notching device (device) 120 (shown in FIG. 7A) that includes cutters 140 shown deployed in FIGS. 7 and 7A. In other embodiments, the cutters 140 may be replaced by rollers as shown in embodiments as discussed above.

Figure 7B:
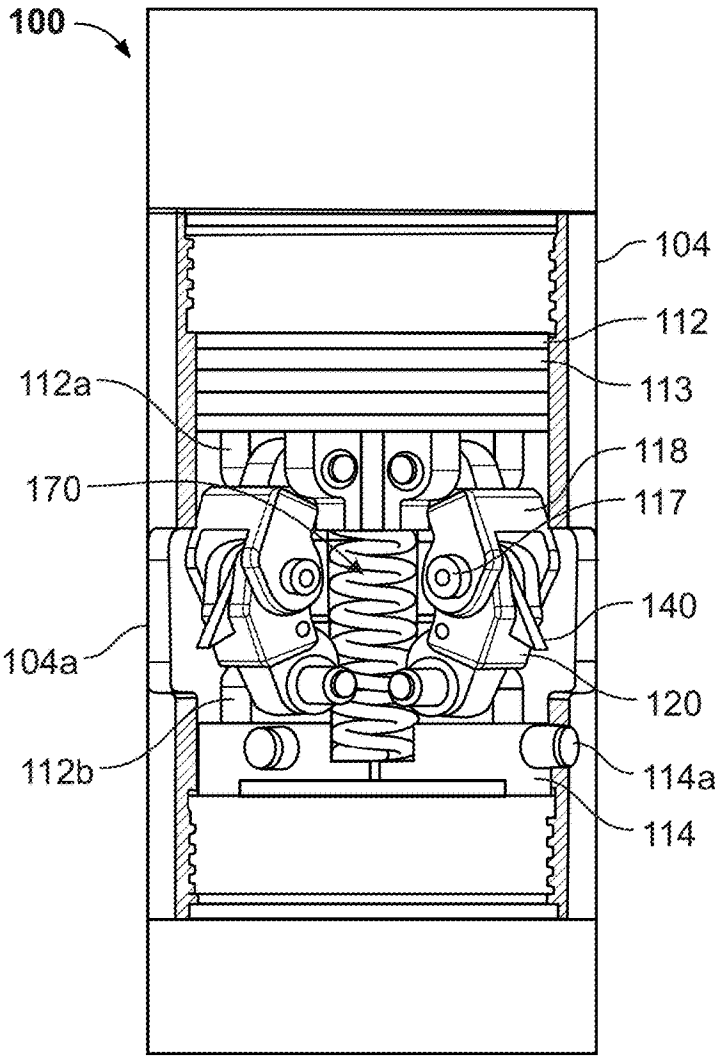
FIG. 7B shows a partial cutaway view of the borehole notching assembly with the cutters retracted.
Figure 7A:
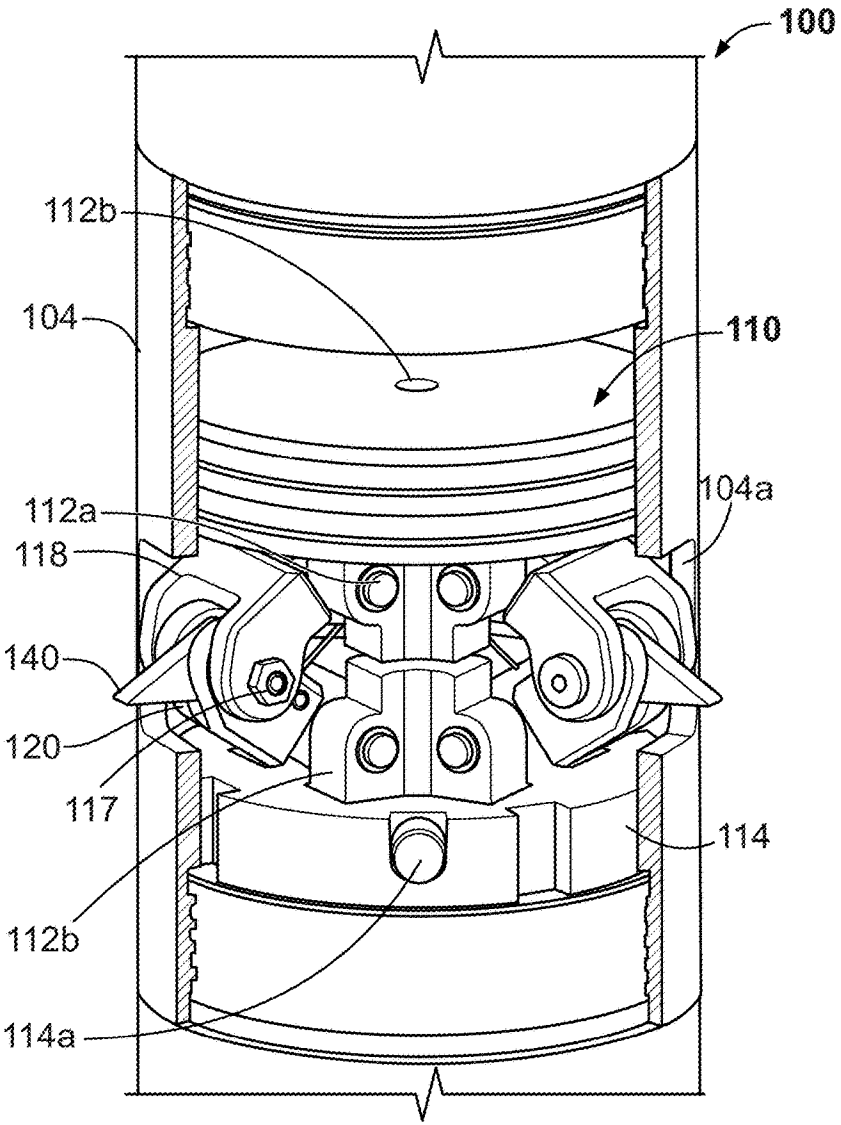
FIG. 7A shows a partial cutaway view of the borehole notching assembly.

FIG. 7A is a partial cutaway view of the assembly 100 including a notching device 110 (device) with cutters 140 deployed. As can be seen in FIG. 7A, the device 110 includes an upper mount fixture 112 and a lower mount fixture 114. Upper and lower yoke mounts 112*a*, 112*b*, are attached to upper and lower mount fixtures 112, 114. Attached to upper and lower yoke mounts 112*a*, 112*b* are upper and lower yokes 118, 120. Cutters 140 are attached to the upper and lower yokes 118, 120 by pin 117 that connects upper and lower yoke assemblies in a pivotable arrangement. The upper mount fixture 112 is axially slidably disposed in the housing 104 and acts as a piston to compress the device 100 when a downward force is applied to the upper mount fixture 112 by fluid pressure. The upper mount fixture 112 includes seals 113 that prevents fluid from passing between the upper mount fixture 112 and the housing 104. The lower mount fixture 114 is axially fixed to the housing 104 by pins 114*a*. As can be further seen in FIG. 7A, the upper mount fixture 112 has been forced towards the lower mount fixture 114 so as to pivot the upper and lower yokes 118, 120 radially outwardly so as to extend the cutters 140 radially outward through openings 104*a* in the housing 104.

FIG. 7B illustrates a partial cutaway view of the device 100 with the cutters 140 retracted. In FIG. 7B, the lower yoke mount 112*b* has been cut away to show a bias spring 170 disposed within. In other embodiments, the bias spring 170 may be disposed within the upper attachment portion 112*a* or both in the upper and lower attachment portions 112*a*, 112*b*. In such a manner, when fluid pressure is not being applied to the upper mount fixture 112 in a sufficient amount to compress bias spring 170 and radially extend the yoke assemblies formed by the upper and lower yokes 118, 120, the bias spring 170 forces the upper and lower mount fixtures 112, 114 apart thereby retracting the yoke assemblies and the cutters 140.

Figure 7C:
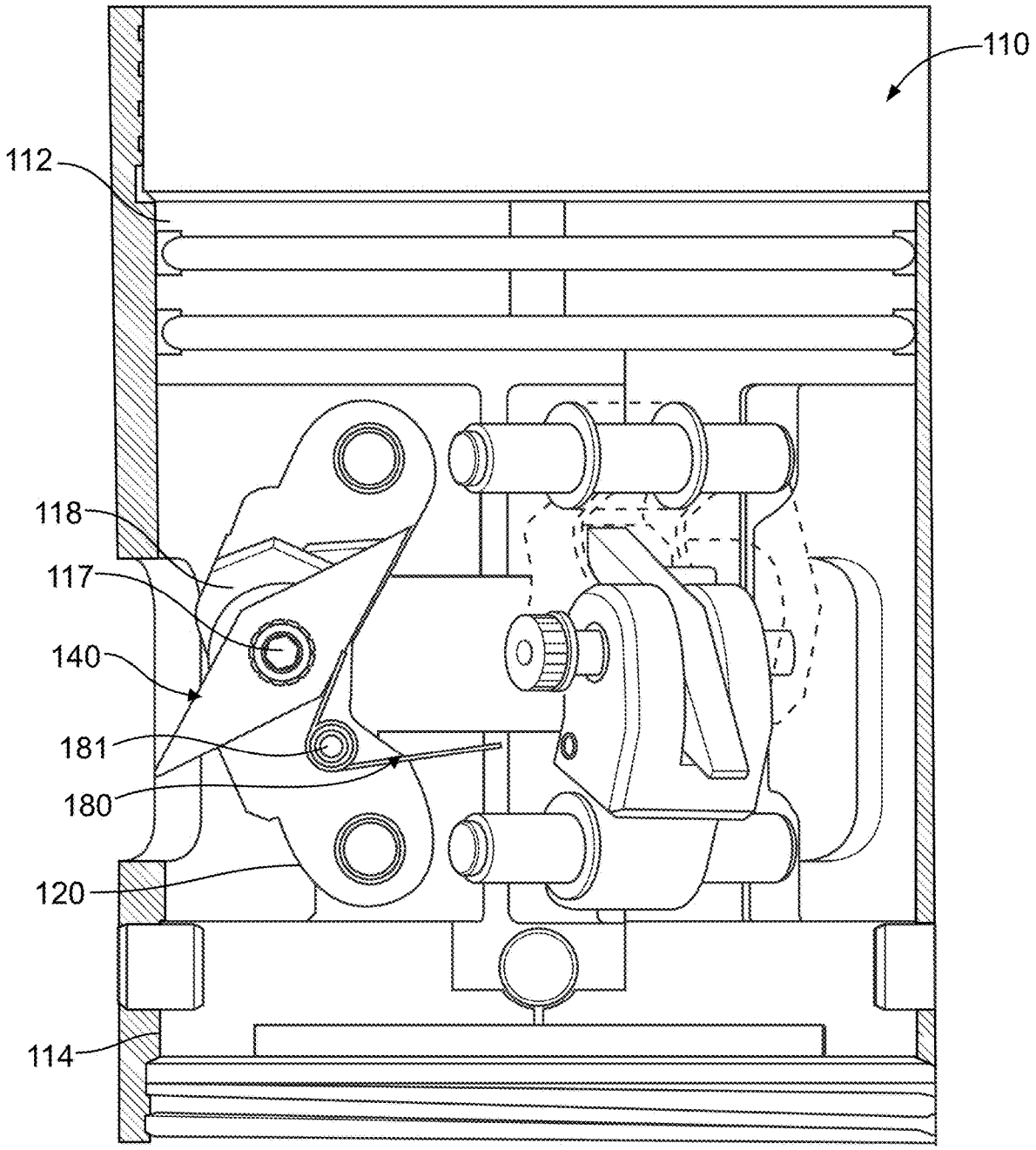
FIG. 7C shows a partial cutaway view of the borehole notching assembly of FIG. 7B.

FIG. 7C shows a portion of FIG. 7B with cutter 140 retracted. As can be seen in FIG. 7C, the cutter 140 is retracted and in contact with upper yoke 118 and is biased to that arrangement with torsion spring 180. In this manner, the cutter 140 is constrained to rotate about the link pin 117. The torsion spring 180 is constrained relative to the lower link with pivot pin 181. The cutter deploys radially when fixture 112 moves towards fixture 114. The contact face between upper yoke 118 and cutter 140 secures the cutter 140 in the deployed configuration. The upper mount fixture 112 is forced towards the lower mount fixture 114 by fluid pressure applied to the top surface of the upper mount fixture 112 from fluid that has entered the passage 101. The fluid may be drilling fluid, water, brine, drilling mud, compressed air or other fluid pressurized in the drill string. As can also be further seen in FIG. 7A, the upper mount fixture 112 also has a fluid passage or orifice 112*c* that allows some fluid to pass through the upper mount fixture 112.

Figure 7D:
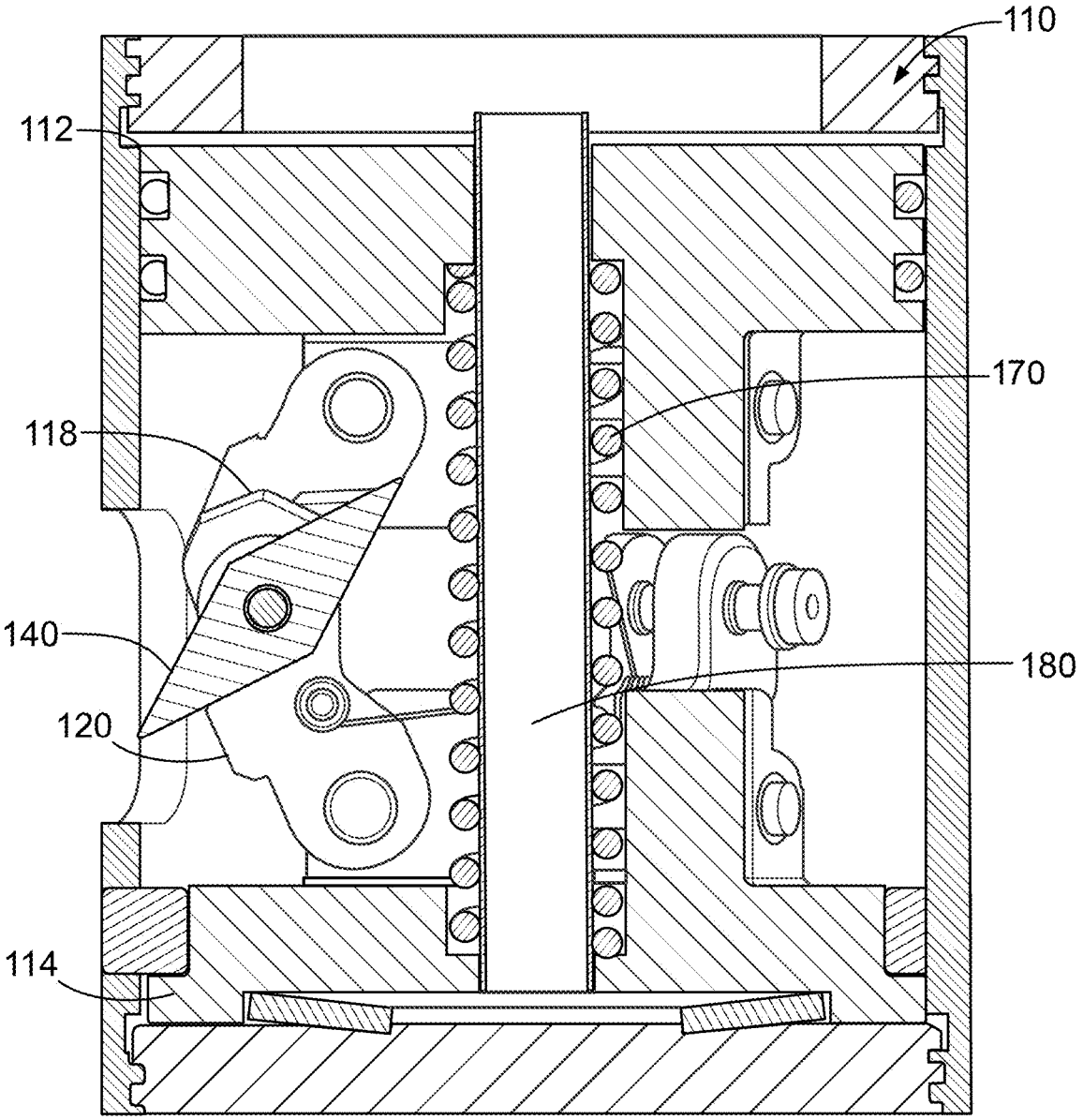
FIG. 7D shows another embodiment of a partial cutaway view of the borehole notching assembly of FIG. 7B.

FIG. 7D shows a partial cutaway view of another embodiment of the device 100. In this embodiment, a feed tube 180 replaces the orifice 112*c* of FIG. 7A so as to allow fluid to pass through the device 100 to a lower device in a stacked configuration (see FIG. 6 for reference). In such a manner, fluid pressure can compress both a top and bottom device 100 to extend cutters 140 or rollers such as shown in FIG. 6.

As can be appreciated from FIGS. 7 and 7B, when the cutters 140 are deployed, the cutters 140 can engage a wellbore surface (see wellbore surface 30 and FIGS. 1 and 3) to form notches in the wellbore surface. In other embodiments, the device 100 may be rotated by rotating the upper portion of the drillstring so as to create a circumferential or partial circumferential notch in the wellbore surface. As discussed in previous embodiments of the disclosure, the cutters 140 may be replaced by rollers or toothed rollers.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the modular device as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. A modular device comprising:

an upper mount fixture and a lower mount fixture disposed opposite thereof and in axial alignment therewith, the upper mount fixture slidably disposed within a housing, wherein the upper mount fixture is driven towards the lower mount fixture by a fluid applying a fluid pressure, the fluid passing through an upper mount fixture passageway, the lower mount fixture positioned within the housing and fixed to the housing so as to not allow for slidable movement within the housing;

two or more yoke assemblies connecting the upper mount fixture and the lower mount fixture;

each yoke assembly comprising an upper yoke and lower yoke to form an articulated joint; and a tool connected to a first end of the upper and lower yokes;

wherein upon moving the upper mount fixture towards the lower mount fixture, the articulated joint moves radially way from the central axis of the housing to radially move the tool away from the axis.

2. The device of claim 1, wherein the tool is a cutter.

3. The device of claim 1, wherein the tool is a roller.

4. The device of claim 1, further comprising:

a bias spring that forces the upper mount fixture and lower mount fixture apart.

5. The device of claim 1, wherein each yoke assembly comprises:

the first end having two yoke arms; and a second end having a yoke arm.

6. The device of claim 1, wherein the upper and lower mount fixtures comprise upper and lower yoke mounts, respectively, to which the upper and lower yokes are pivotally attached, respectively.

7. The device of claim 1, wherein the tool is attached to the yoke assembly by a cross bolt.

8. An assembly comprising two or more devices of claim 1.

9. A drillstring comprising one or more devices of claim 1.

10. A method for axially aligning a drillstring in a well borehole having a borehole surface, comprising:

adding to a drillstring above the drilling motor a device that deploys tools against the borehole surface at an axial location where the device is axially located within the borehole;

disposing the drillstring into the borehole;

applying fluid pressure from a fluid to the device to deploy the tools against the borehole surface at the axial location;

wherein the device comprises:

an upper mount fixture and a lower mount fixture disposed opposite thereof and in axial alignment therewith, the upper mount fixture slidably disposed within a housing, wherein the upper mount fixture is driven towards the lower mount fixture by a fluid applying a fluid pressure, the fluid passing through an upper mount fixture passageway, the lower mount fixture positioned within the housing and fixed to the housing so as to not allow for slidable movement within the drillstring;

the upper mount fixture and the lower mount fixture connected by at least two yoke assemblies;

each yoke assembly comprising an upper yoke and lower yoke to form an articulated joint; and the tool connected to a first end of the upper and lower yokes;

wherein upon moving the upper mount fixture towards the lower mount fixture, the articulated joint moves radially way from the central axis of the housing.

11. The method of claim 10, wherein the fluid is selected from the group consisting of drilling fluid, water, brine and drilling mud.

12. The method of claim 10, wherein the tools are rollers and deploying the tool centralizes a drillstring.

13. The method of claim 10, wherein the tools are blades and wherein deploying the tools notches the borehole.

14. The method of claim 10, wherein the device further comprises:

using a bias spring to force the upper mount fixture and lower mount fixture apart.

15. The method of claim 10, wherein each yoke assembly comprises:

the first end having two yoke arms; and a second end having a yoke arm.

16. The method of claim 10, wherein the upper and lower mount fixtures comprise upper and lower yoke mounts, respectively, to which the upper and lower yokes are pivotally attached, respectively.

* * * * *